US010441955B2

(12) United States Patent
Hao

(10) Patent No.: US 10,441,955 B2
(45) Date of Patent: Oct. 15, 2019

(54) ROLLER MILL

(71) Applicant: Changsha Shenxiang Universal Machine Co., Ltd., Changsha, Hunan (CN)

(72) Inventor: Zhigang Hao, Hunan (CN)

(73) Assignee: CHANGSHA SHENXIANG UNIVERSAL MACHINE CO., LTD., Changsha, Hunan (CN)

( * ) Notice: Subject to any disclaimer, the term of this patent is extended or adjusted under 35 U.S.C. 154(b) by 506 days.

(21) Appl. No.: 15/033,867

(22) PCT Filed: Nov. 4, 2014

(86) PCT No.: PCT/CN2014/090272
§ 371 (c)(1),
(2) Date: May 2, 2016

(87) PCT Pub. No.: WO2015/067167
PCT Pub. Date: May 14, 2015

(65) Prior Publication Data

US 2016/0271615 A1 Sep. 22, 2016

(30) Foreign Application Priority Data

Nov. 5, 2013 (CN) ..... 2013 1 0542987

(51) Int. Cl.
*B02C 15/00* (2006.01)
*B02C 15/08* (2006.01)
(Continued)

(52) U.S. Cl.
CPC ..... *B02C 15/02* (2013.01); *B02C 15/00* (2013.01); *B02C 15/06* (2013.01); *B02C 15/08* (2013.01);
(Continued)

(58) Field of Classification Search
CPC ..... B02C 15/00; B02C 15/02; B02C 15/04; B02C 15/06; B02C 15/08; B02C 15/14; B02C 201/00855; B02C 2015/008
(Continued)

(56) References Cited

U.S. PATENT DOCUMENTS 1,706,254 A * 3/1929 Rees ..... B02C 15/02 126/39 C
2,413,603 A * 12/1946 Christensen ..... B22C 5/0427 241/124
(Continued)

FOREIGN PATENT DOCUMENTS

AT 231791 B 2/1964
CN 2194214 Y 4/1995
(Continued)

OTHER PUBLICATIONS

CN-2194214-Y—HAO—English Machine Translation (Year: 1995).*
(Continued)

*Primary Examiner* — Shelley M Self
*Assistant Examiner* — Katie L. Parr
(74) *Attorney, Agent, or Firm* — Schwabe Williamson & Wyatt, PC

(57) ABSTRACT

A roller mill includes a shell provided with a feed port and a discharge port; a main shaft inserted in the shell and rotatable in the shell; a drive device drivingly connected to the main shaft a holder mounted on the main shaft two or more than two grinding rollers, each of the grinding rollers mounted on the holder and rotatable around its own axis; and a grinding disk fixedly mounted in the shell at a position opposite to the multiple grinding rollers. The roller mill further includes an axial position adjustment device connected to the main shaft and configured to drive the main shaft to move axially to adjust a position of the main shaft.

18 Claims, 4 Drawing Sheets

(51) Int. Cl.
*B02C 15/02* (2006.01)
*B02C 15/06* (2006.01)
*B02C 15/14* (2006.01)

(52) U.S. Cl.
CPC ..... *B02C 15/14* (2013.01); *B02C 2015/008* (2013.01)

(58) Field of Classification Search
USPC ..... 241/107–11, 123–133, 293
See application file for complete search history.

(56) References Cited

U.S. PATENT DOCUMENTS 3,337,142 A * 8/1967 Williams ..... B02C 15/02 241/130
4,022,387 A * 5/1977 Williams ..... B02C 15/02 241/130
4,682,738 A * 7/1987 Chang ..... B02C 15/02 241/129
6,446,888 B1 * 9/2002 Williams, Sr. ..... B02C 15/001 241/79.1
2009/0121060 A1 * 5/2009 Chen ..... B02C 15/003 241/110

FOREIGN PATENT DOCUMENTS

CN 1110194 A 10/1995
CN 2389002 Y 7/2000
CN 102225349 A 10/2011
CN 103567020 A 2/2014
CN 203750611 U 8/2014
DE 3409710 A1 * 9/1984 ..... B02C 15/14
KR 100809900 B1 3/2008
WO 2009/007149 A1 1/2009

OTHER PUBLICATIONS

Extended European Search Report for Application No. 14860641.1 dated Jun. 8, 2017; 7 pages.
English translation of AT231791 B; dated Feb. 10, 1964, Loesche KG; 6 pages.

* cited by examiner

ROLLER MILL

CROSS REFERENCE TO RELATED APPLICATION

The present application is the national phase of International Application No. PCT/CN2014/090272, titled "ROLLER MILL", filed on Nov. 4, 2014, which claims the benefit of priority to Chinese patent application No. 201310542987.5 titled "ROLLER MILL" and filed with the Chinese State Intellectual Property Office on Nov. 5, 2013, the entire disclosures of which are incorporated herein by reference.

FIELD

This application relates to the technical field of comminution machinery, and particularly relates to a roller mill.

BACKGROUND

A roller mill is disclosed in Chinese Patent No. ZL94110912.7, which includes a grinding disk, grinding rollers, a main shaft, a holder, a base, an upper shell and a lower shell. The grinding disk is located in the lower shell. The grinding rollers are movably mounted above the grinding disk by the holder. The holder is mounted to the base by the driving main shaft, and is located in the upper shell. The holder is driven by the main shaft and a belt pulley. A hopper is mounted on the base, a discharge tube is mounted below the lower shell, and an adjustable gap is presented between a grinding surface of the grinding disk and the grinding roller, to form gap-type grinding surfaces. When the main shaft mounted at the upper portion rotates, the main shaft drives the holder to rotate, and the holder in turn drives the several grinding rollers distributed at the periphery of the holder to revolve around the main shaft. The grinding disk does not rotate, and when materials pass by the grinding disk corresponding to the grinding rollers, the grinding rollers will revolve around the main shaft and at the same time revolve on its own axis by friction torques, thus in this way, the materials will be crushed by the rolling of the grinding rollers and the grinding disk. An elastic mechanism is mounted on a connecting bolt between the upper shell and the lower shell, to prevent a situation that an oversize materials are stuck when passing between the grinding surface of the grinding disk and the grinding rollers.

The above patent has the following issues.

1. Providing an adjusting screw and the elastic mechanism outside the shell may result in a complicated structure, and the several outer shells are required to be guided and positioned, which imposes a high requirement on the manufacture, requires a large processing amount, and increases possibilities of occurrence of various faults of the device.

2. Most of regulations and adjustments of the device must be manually operated, and these operations must be performed after the equipment stops, which increases the labor intensity and wastes production time.

SUMMARY

An object of the present application is to provide a roller mill which has a simple structure, and can adjust a grinding gap conveniently.

To achieve the above objects, a roller mill is provided according to the present application, and includes a shell provided with a feed port and a discharge port; a main shaft inserted in the shell and rotatable in the shell; a drive device drivingly connected to the main shaft; a holder mounted on the main shaft; two or more than two grinding rollers, each of the grinding rollers mounted on the holder and rotatable around its own axis; and a grinding disk fixedly mounted in the shell at a position opposite to the multiple grinding rollers. The roller mill further includes an axial position adjustment device connected to the main shaft and configured to drive the main shaft to move axially to adjust a position of the main shaft.

Further, the axial position adjustment device is a hydraulic cylinder, the hydraulic cylinder is arranged along a vertical direction, and includes a cylinder body, a piston rod, and a piston, the cylinder body is fixedly arranged, and the piston divides an inner cavity of the cylinder body into an upper cavity and a lower cavity, and the piston rod is movably connected to the main shaft and is configured to drive the main shaft to move axially to adjust the position of the main shaft.

Further, the roller mill according to the present application further includes: a reset device configured to apply an axial restoring force on the main shaft after the main shaft moves axially.

Further, the reset device includes an accumulator, and the accumulator is in communication with the upper cavity.

Further, the roller mill according to the present application further includes: a base, the shell is supported on the base, and the main shaft is supported by the base, the main shaft has a free end located in the shell; and the drive device and the hydraulic cylinder of the roller mill are both located below the base, and the piston rod extends upward, and is movably connected to the main shaft via the drive device and is configured to drive the main shaft to move axially.

Further, the roller mill according to the present application further includes: a base, the shell is supported on the base, the main shaft is supported by the base and a top cover of the shell; and the drive device and the hydraulic cylinder of the roller mill are both located below the base or both located above the shell, and the piston rod is movably connected to the main shaft via the drive device, and is configured to drive the main shaft to move axially, and the hydraulic cylinder is located at a side, away from the grinding rollers, of the drive device.

Further, the roller mill according to the present application further includes: a base, the shell is supported on the base, and the main shaft is supported by the base and a top cover of the shell; and the drive device of the roller mill is located above the shell, the hydraulic cylinder is located below the base, and the piston rod is movably connected to the main shaft.

Further, the roller mill according to the present application further includes: a base, the shell is supported on the base, the main shaft is supported by the base and a top cover of the shell; and the drive device of the roller mill is located below the base, the hydraulic cylinder is located above the shell, and the piston rod is movably connected to the main shaft.

Further, the main shaft is supported by a top cover of the shell, the main shaft has a free end located in the shell, the drive device and the hydraulic cylinder are both located above the shell, and the piston rod extends downward, and is movably connected to the main shaft via the drive device, and is configured to drive the main shaft to move axially.

Further, each of the grinding rollers is mounted on the holder by a respective rocker arm mechanism. The rocker arm mechanism includes an articulating seat arranged on the holder; a rocker arm, a position-limiting device and an elastic device. The rocker arm includes a first arm and a second arm connected to each other, the grinding roller is mounted to the first arm, and the first arm and the second arm are connected with a bent transition, and a portion where the first arm and the second arm are connected is articulated to the articulating seat. The position-limiting device is connected to the second arm to adjust a distance between the second arm and the holder, the position-limiting device includes a first bolt passing through the rocker arm and a first nut connected to the first bolt, a bolt head of the first bolt is located between the rocker arm and the holder, and the first nut is located above the rocker arm, one or more spacers are selectively provided between the bolt head of the first bolt and the rocker arm. The elastic device has an elastic member configured to apply a pressure towards the holder on the second arm, the elastic device includes a second bolt passing through the holder and the rocker arm, and a second nut connected to the second bolt, a bolt head of the second bolt is located below the holder, the second nut is located above the rocker arm, and the elastic member is provided between the second nut and the rocker arm.

Further, the roller mill according to the present application further includes a base, the shell is supported on the base, the main shaft is supported by the base and a top cover of the shell, the roller mill includes two axial position adjustment devices, and the two axial position adjustment devices are respectively cooperated with or connected to two ends of the main shaft, and are configured to drive the main shaft to move axially, to adjust the position of the main shaft.

Further, the roller mill according to the present application further includes a base, the shell is supported on the base, the main shaft is supported by the base and a top cover of the shell; the axial position adjustment device of the roller mill cooperates with or connects to a lower end of the main shaft, and is configured to drive the main shaft to move axially, to adjust the position of the main shaft, the reset device is located on an upper end of the main shaft.

The technical solutions of the present application provide the axial position adjustment device, thus the main shaft can be driven by the axial position adjustment device to move axially, to adjust the position of the main shaft, and further the grinding rollers can be brought to move along the vertical direction, thus the grinding gap between the grinding rollers and the grinding disk can be adjusted conveniently. The grinding roller according to the present application has a simple structure, and is convenient to adjust.

BRIEF DESCRIPTION OF THE DRAWINGS

Drawings of the specification constituting a part of the present application are used to help further understanding of the present application, and exemplary embodiments of the present application and its explanation are used to interpret the present application, and do not constitute inappropriate limitation to the present application. In the drawings.

DETAILED DESCRIPTION

It is to be noted that, embodiments of the present application and features in the embodiments can be combined with each other without causing conflict. The present application will be described in detail hereinafter with reference to the drawings and the embodiments.

Figure 1:
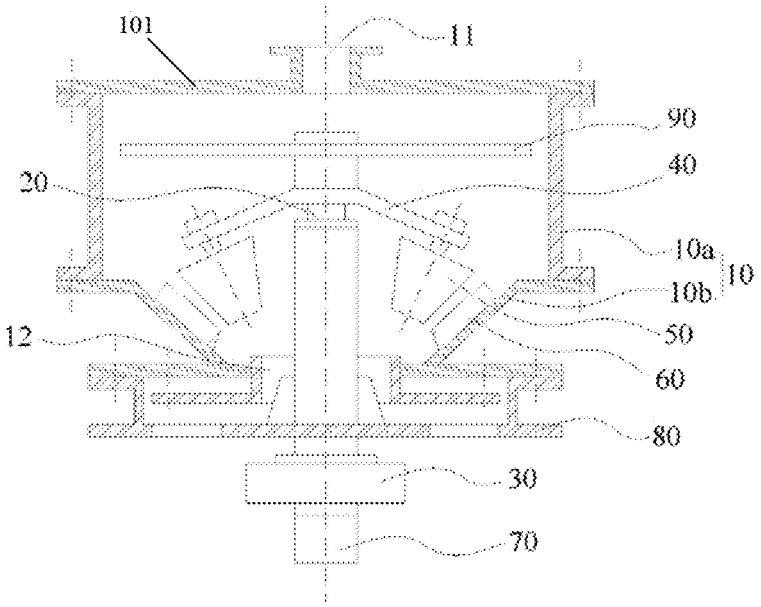
FIG. 1 is a schematic view showing the structure of a roller mill according to a first embodiment of the present application.

As shown in FIG. 1, a roller mill according to a first embodiment of the present application includes a shell 10, a main shaft 20, a drive device 30, a holder 40, two or more than two grinding rollers 50, a grinding disk 60, an axial position adjustment device 70 and a base 80. The axial position adjustment device 70 may include a screw mechanism, or may include a spacer mechanism, and may also be a hydraulic cylinder, and etc., and may also be other combinations of these mechanisms.

The shell 10 is supported on the base 80. The shell 10 includes a top cover 101, a first shell 10*a*, a second shell 10*b* which are connected and arranged from top to bottom in the listed sequence, and the first shell and the second shell may also be formed as an integral structure. A feed port 11 is provided in the cover, and a discharge port 12 is provided in the second shell. The main shaft 20 is inserted into the shell 10, and is rotatable in the shell 10, and the main shaft 20 is supported by the base 80. The main shaft 20 has a free end located in the shell 10. The drive device 30 is drivingly connected to the main shaft 20, to drive the main shaft 20 to rotate. The holder 40 is mounted on the main shaft 20, and may rotate synchronously with the main shaft 20. Each of the grinding rollers 50 is mounted on the holder 40 and is rotatable around its own axis, that is, each of the grinding rollers 50 can revolve around a center line of the main shaft 20, and revolve around its own center line. The grinding disk 60 is fixedly mounted in the shell 10, and is arranged opposite to the multiple grinding rollers 50, to cooperate with the grinding rollers 50 to perform the grinding of materials.

Figure 2:
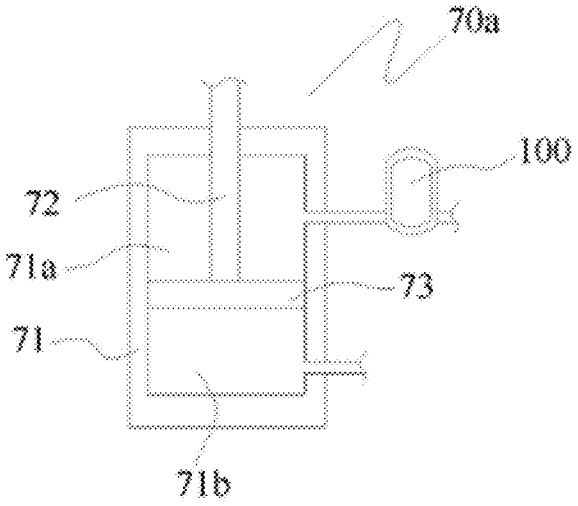
FIG. 2 is a schematic view showing the structures of a hydraulic cylinder and an accumulator of a roller mill according to a second embodiment of the present application.

As shown in FIG. 2, in the first embodiment, the axial position adjustment device includes a hydraulic cylinder 70*a*. The hydraulic cylinder 70*a* is arranged in a vertical direction. The hydraulic cylinder 70*a* includes a cylinder body 71, a piston rod 72, and a piston 73. The cylinder body 71 is fixedly arranged. The drive device 30 and the hydraulic cylinder 70*a* are both located below the base 80. The piston rod 72 extends upward, and is movably connected to the main shaft 20 via the drive device 30, and can drive the main shaft 20 to move axially. The above movable connection means that the piston rod 72 is immobile, and is not rotatable, however, the main shaft 20 is rotatable. Such movable connection may be achieved by providing a mechanical rotation converting device between the main shaft 20 and the piston rod 72.

The technical solution of the first embodiment provides the hydraulic cylinder 70*a*, thus the main shaft 20 may be driven by the hydraulic cylinder 70*a* to move axially to adjust the position of the main shaft 20, and the main shaft 20 may further drive the grinding rollers 50 to move along the vertical direction. In this way, a grinding gap between the grinding rollers 50 and the grinding disk 60 may be conveniently adjusted. The roller mill according to this embodiment has a simple structure, and is convenient to adjust. The adjusted position of the main shaft 20 may be a set position, and may also be a variable position formed by continuous movement or discontinuous movement of the main shaft 20 during the grinding process.

In other embodiments, the axial position adjustment device 70 may also rotate synchronously with the main shaft 20, and in this case, the axial position adjustment device 70 and the main shaft 20 are not required to be movably connected, and may be fixedly connected.

As shown in FIG. 2, a roller mill according to a second embodiment of the present application includes a shell 10, a main shaft 20, a drive device 30, a holder 40, multiple grinding rollers 50, a grinding disk 60, an axial position adjustment device 70, a reset device, and a base 80. Unlike the first embodiment, the second embodiment further includes the reset device, and the reset device can apply an axial restoring force on the main shaft 20 after the main shaft 20 moves axially. In this way, in addition to adjusting the position of the main shaft 20, i.e., to obtain a reasonable grinding gap, the gap between the grinding rollers and the grinding disk may be reset in the operation after the gap is enlarged by wear. In the second embodiment, the axial position adjustment device includes a hydraulic cylinder 70*a*, and the reset device is an accumulator 100. In other embodiments not illustrated, the reset device may also be a spring structure, an air cylinder mechanism and etc. The magnitude of the restoring force set by the reset device actually limits or determines the magnitude of the pressure applied by the grinding rollers 50 to the grinding disk 60.

As shown in FIG. 2, the hydraulic cylinder 70*a* is arranged along a vertical direction, and includes a cylinder body 71, a piston rod 72, and a piston 73. The cylinder body 71 is fixedly arranged. As shown in FIG. 2, the piston 73 divides an inner cavity of the cylinder body 71 into an upper cavity 71*a* and a lower cavity 71*b*, and in this embodiment, the upper cavity 71*a* is a rod cavity, and the lower cavity 71*b* is a rodless cavity. The accumulator 100 is in communication with the upper cavity 71*a*. The drive device 30 and the hydraulic cylinder 70*a* are both located below the base 80. The piston rod 72 extends upward and is movably connected to the main shaft 20 via the drive device 30, and can drive the main shaft 20 to move axially.

In the second embodiment, the piston rod 72 of the hydraulic cylinder 70*a* can drive the main shaft 20 to move axially, to adjust the main shaft 20 to an appropriate set position, and may further bring the grinding rollers 50 to move along the vertical direction. In this way, a grinding gap between the grinding rollers 50 and the grinding disk 60 can be conveniently adjusted, or the enlarged gap between the grinding rollers 50 and the grinding disk 60 caused by wear can be adjusted or compensated. Also, the pressure maintaining of the hydraulic cylinder 70*a* may apply a working pressure on the grinding rollers 50. When a large uncrushable object such as a tramp iron enters the space between the grinding rollers 50 and the grinding disk 60, the grinding rollers 50 generate a large axial force, which forces the main shaft 20 to move axially to be away from the set position. The main shaft 20 at this time will compress hydraulic oil in the upper cavity 71*a*, and the hydraulic oil is pressed into the accumulator 100 in communication with the upper cavity 71*a*, to compress a gasbag filled with pressurized gas, thus the piston rod 72 is driven to move upward, to further bring the grinding rollers 50 to move upward to increase the gap between the grinding rollers 50 and the grinding disk 60, to allow the tramp iron or the like to pass. After the tramp iron and the like is discharged, the pressure in the gasbag of the accumulator 100 forces the hydraulic oil to push the piston 73 and the piston rod 72, to apply an axial restoring force on the main shaft 20 which has moved axially away from the set position, to allow the main shaft 20 to return to the set position, and further recover the grinding gap between the grinding rollers 50 and the grinding disk 60, and the normal operation of grinding materials is continued. If the gap between the grinding rollers 50 and the grinding disk 60 is adjusted to be small and the thickness of a material layer is great, the grinding rollers 50, the holder 40 and the main shaft 20 may compress the hydraulic oil in the upper cavity 71*a* according to the thickness of the material layer and the size of particles of the material, to generate an axial movement floating up and down, and the grinding rollers 50 also crush the material under the floating condition. Therefore, the roller mill according to the second embodiment has a simple structure, and can adjust the grinding gap automatically. Preferably, the roller mill according to the second embodiment also includes a spreading disk 90 mounted on the main shaft 20 and moving synchronously with the main shaft 20, and the spreading disk 90 is located above the holder 40.

The operating process of the roller mill according to the second embodiment is described as follows.

When the main shaft 20 is driven by the drive device 30 to rotate, the material to be crushed is fed from the feed port 11 and falls on the spreading disk 90 rotating synchronously with the main shaft 20. The rotating spreading disk 90 distributes the material to the periphery of the first shell to allow the material to fall between the grinding rollers 50 and the grinding disk 60 mounted on the second shell. A gap is presented between the grinding rollers 50 and the grinding disc 60. Two or more than two grinding rollers 50 mounted on the holder 6 and distributed at the periphery of the holder 6 revolve around the center line of the main shaft 20, and each revolves around its own center line under the action of friction torque, thus when falling from top to bottom, the material is grinded by the grinding rollers 50 multiple times to be crushed, and finally is discharged from the discharge port 12.

Figure 3:
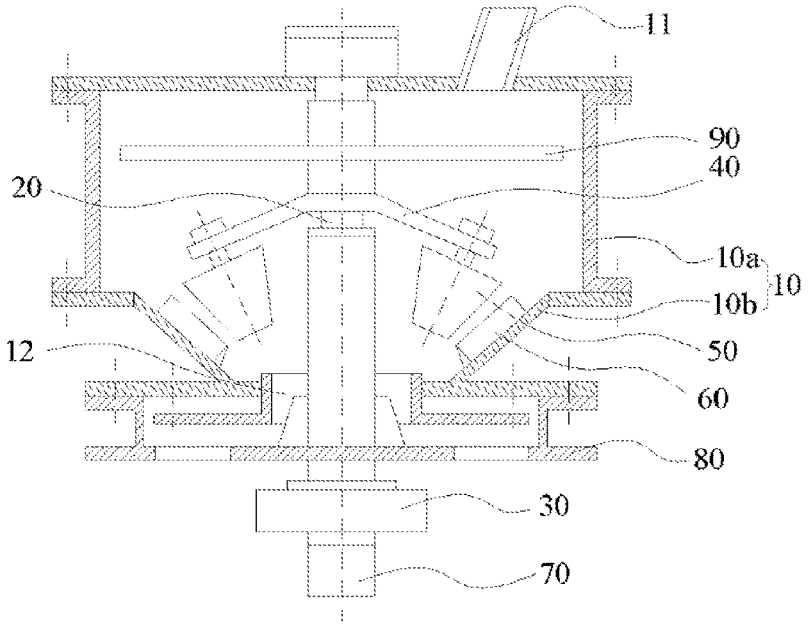
FIG. 3 is a schematic view showing the structure of a roller mill according to a third embodiment of the present application.

As shown in FIG. 3, a roller mill according to a third embodiment of the present application includes a shell 10, a main shaft 20, a drive device 30, a holder 40, multiple grinding rollers 50, a grinding disk 60, an axial position adjustment device 70, a reset device, and a base 80. The axial position adjustment device includes a hydraulic cylinder 70*a*, and the reset device is an accumulator 100. Unlike the second embodiment, in the third embodiment, the main shaft 20 is supported by the base 80 and a top cover of the shell 10, and the drive device 30 and the hydraulic cylinder 70*a* are both located below the base 80. Furthermore, a piston rod 72 is connected to the main shaft 20 by the drive device 30 and can drive the main shaft 20 to move axially, and the hydraulic cylinder 70*a* is located at a side away from the grinding rollers 50, of the drive device 30. The operating principle of this embodiment is substantially the same as that of the second embodiment, and will not be described further here.

Figure 6:
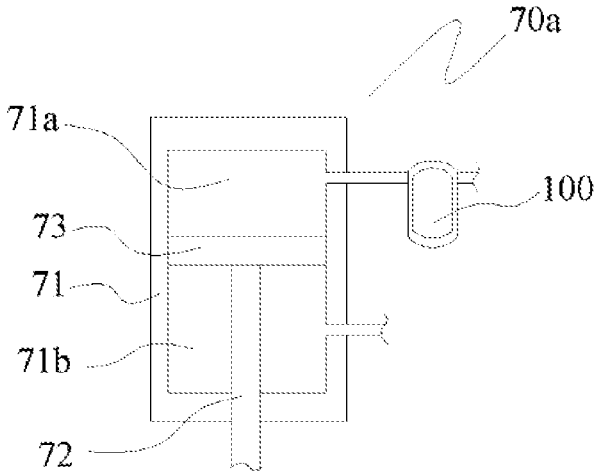
FIG. 6 is a schematic view showing the structures of a hydraulic cylinder and an accumulator of a roller mill in FIG. 5.

In a fourth embodiment not illustrated, similar to the structure in the third embodiment, a main shaft 20 is supported by a base 80 and a top cover of a shell 10. Unlike the third embodiment, in the fourth embodiment, a drive device 30 and an axial position adjustment device 70 are both located above the shell 10. In the case that the axial position adjustment device is embodied as a hydraulic cylinder 70*a* and the hydraulic cylinder 70*a* is located above the shell, the structure of the hydraulic cylinder 70*a* is shown in FIG. 6, and in this case, an upper cavity 71*a* is a rodless cavity, and a lower cavity 71*b* is a rod cavity. Similar to the working principle of the hydraulic cylinder 70*a* in the above embodiments, in this embodiment, when a large uncrushable object, such as a tramp iron, enters the space between the grinding rollers 50 and the grinding disk 60, hydraulic oil in the upper cavity 71*a* will be pressed into an accumulator 100 in communication with the upper cavity 71*a*, thus the piston rod 72 is driven to move upward, to further bring the grinding rollers 50 to move upward to enlarge the gap between the grinding rollers 50 and the grinding disk 60, to allow the tramp iron and the like stuck in the gap to pass.

Figure 4:
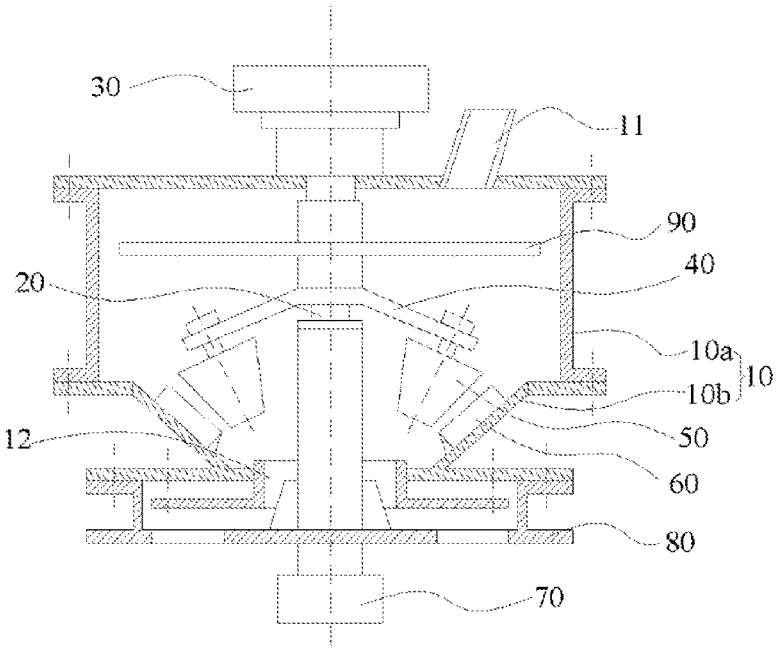
FIG. 4 is a schematic view showing the structure of a roller mill according to a fifth embodiment of the present application.

As shown in FIG. 4, a roller mill according to a fifth embodiment of the present application includes a shell 10, a main shaft 20, a drive device 30, a holder 40, two or more than two grinding rollers 50, a grinding disk 60, an axial position adjustment device 70, a reset device, and a base 80. The axial position adjustment device includes a hydraulic cylinder 70*a*, and the reset device is an accumulator 100. The main shaft 20 is supported by the base 80 and a top cover of the shell 10. Unlike the fourth embodiment, in the fifth embodiment, the drive device 30 is located above the shell 10, and the hydraulic cylinder 70*a* is located below the base 80, and a piston rod 72 is movably connected to the main shaft 20.

In a sixth embodiment not illustrated, similar to the structure of the fifth embodiment, a main shaft 20 is supported by a base 80 and a top cover of a shell 10. Unlike the fifth embodiment, in the sixth embodiment, a drive device 30 is located below the base 80, a hydraulic cylinder 70*a* is located above the shell 10, and a piston rod 72 is movably connected to the main shaft 20.

Figure 5:
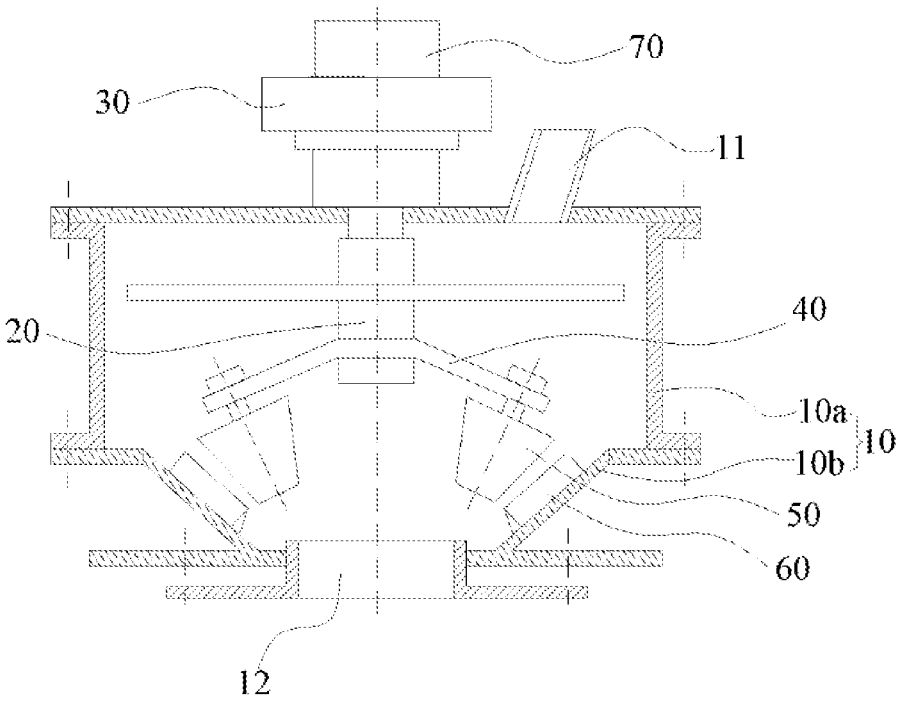
FIG. 5 is a schematic view showing the structure of a roller mill according to a seventh embodiment of the present application.

As shown in FIG. 5, a roller mill according to a seventh embodiment of the present application includes a shell 10, a main shaft 20, a drive device 30, a holder 40, two or more than two grinding rollers 50, a grinding disk 60, an axial position adjustment device 70, and a reset device. The axial position adjustment device 70 includes a hydraulic cylinder 70*a*, the reset device is an accumulator 100. Unlike the fifth embodiment, the seventh embodiment does not include a base 80, and the main shaft 20 is supported by a top cover of the shell 10. The main shaft 20 has a free end located in the shell 10 at a lower portion. The drive device 30 and the hydraulic cylinder 70 are both located above the shell 10. The piston rod 72 extends downward, and is movably connected to the main shaft 20 via the drive device 30, and can drive the main shaft 20 to move axially. Such movable connection between the piston rod 72 and the main shaft 20 may be achieved by a mechanical rotation converting device, i.e., a device configured to convert rotation of one end to non-rotation of another end. FIG. 6 shows the structure of the hydraulic cylinder 70*a* according to the seventh embodiment, in this case, an upper cavity 71*a* is a rodless cavity, and a lower cavity 71*b* is a rod cavity.

Figure 7:
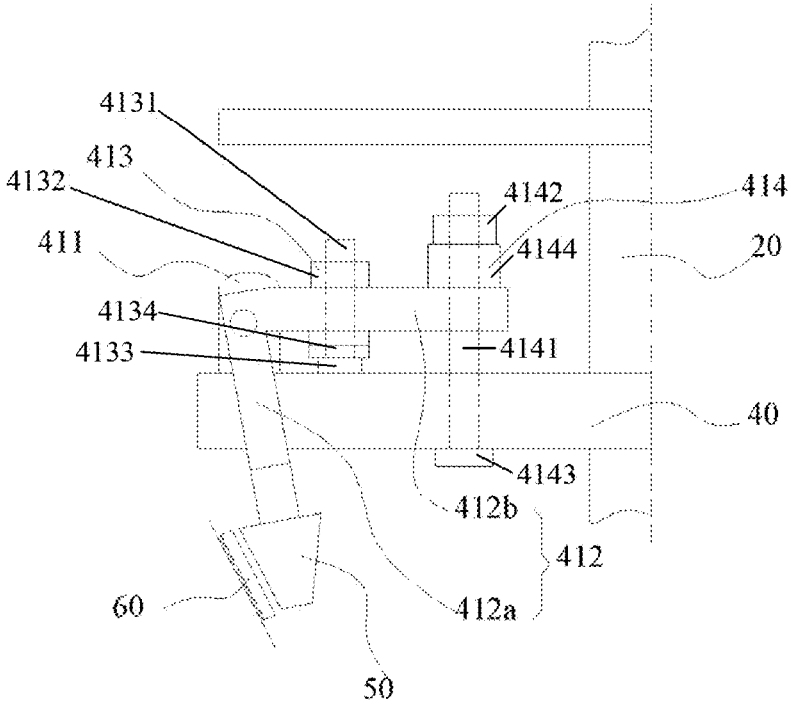
FIG. 7 is a schematic view showing the assembly of a grinding roller of a roller mill according to an eighth embodiment of the present application.

As shown in FIG. 7, the difference of a roller mill according to an eighth embodiment of the present application from the above embodiments lies in the manner of fixing the grinding rollers 50 on the holder 40. In the eighth embodiment, each of the grinding rollers 50 is mounted on the holder 40 by a rocker arm mechanism. The rocker arm mechanism includes an articulating seat 411, a rocker arm 412, a position-limiting device 413, and an elastic device 414. The articulating seat 411 is arranged on the holder 40. The rocker arm 412 includes a first arm 412*a* and a second arm 412*b* connected to each other. The grinding roller 50 is mounted on the first arm 412*a*, the first arm 412*a* and the second arm 412*b* are connected with a bent transition, and the joint between the first arm 412*a* and the second arm 412*b* is articulated to the articulating seat 411. The position-limiting device 413 is connected to the second arm 412*b* to adjust the distance between the second arm 412*b* and the holder 40, to adjust the gap between the grinding roller 50 and the grinding disk 60. The elastic device 414 has an elastic member configured to apply a pressure towards the holder 40 on the second arm 412*b*, and the elastic device 414 can be used to apply a pressure on the grinding roller 50. The main shaft 20 of the roller mill according to the seventh embodiment may be supported in the manner according to any one of the above embodiments.

In this embodiment, the position-limiting device 413 includes a first bolt 4131 passing through the rocker arm 412, and a first nut 4132 connected to the first bolt 4131. A bolt head 4133 of the first bolt 4131 is located between the rocker arm 412 and the holder 40, and the first nut 4132 is located above the rocker arm 412. One or multiple spacers 4134 may be selectively provided between the bolt head 4133 of the first bolt 4131 and the rocker arm 412. The elastic device 414 includes a second bolt 4141 passing through the holder 40 and the rocker arm 412, and a second nut 4142 connected to the second bolt 4141. A bolt head 4143 of the second bolt 4141 is located below the holder 40, the second nut 4142 is located above the rocker arm 412, and an elastic member 4144 is provided between the second nut 4142 and the rocker arm 412.

Of course, as a feasible manner, shapes and mounting positions of the rocker arm, the elastic device of the position—limiting device may have various changes, for example, in a vertical roller mill disclosed in Chinese Patent No. ZL99233773.9, the mounting manner of a grinding roller 50 is similar to the manner in the fifth embodiment, however, a position-limiting device in the Chinese Patent No. ZL99233773.9 is disposed below the holder, and an elastic device is disposed in an annular groove at a lower portion of the holder.

Figure 8:
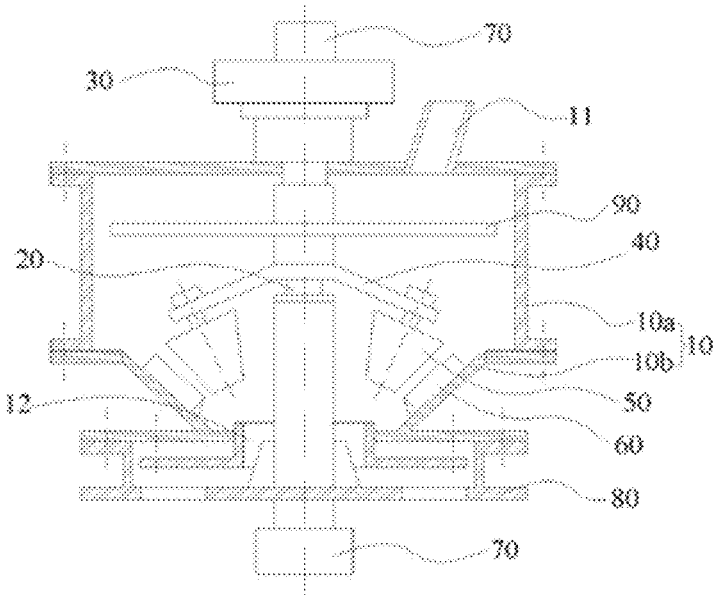
FIG. 8 is a schematic view showing the assembly of a grinding roller of a roller mill according to a ninth embodiment of the present application.

As shown in FIG. 8, a roller mill according to a ninth embodiment of the present application includes a shell 10, a main shaft 20, a drive device 30, a holder 40, multiple grinding rollers 50, a grinding disk 60, two axial position adjustment devices 70, and a base 80. Two ends of the main shaft 20 are respectively supported by a top cover of the shell 10 and the base 80. The two axial position adjustment devices 70 are respectively arranged at two ends of the main shaft 20, and cooperated with or connected to the two ends of the main shaft 20. Each of the axial position adjustment devices 70 may be a hydraulic cylinder, a screw mechanism, or a spacer device, and the upper axial position adjustment device 70 may also be a hydraulic cylinder with an accumulator.

The only difference between the structure in a tenth embodiment of the present application and the structure in the ninth embodiment lies in that, in the tenth embodiment, the upper axial position adjustment device in FIG. 8 is changed as a reset device, and all the other structures are not changed. The reset device may be an accumulator, a cylinder device, or a spring device.

When it is required to adjust the gap between the grinding rollers 50 and the grinding disk 60, the axial position adjustment device may be adjusted, to allow the main shaft 20 to be displaced, to increase or decrease the gap between the grinding rollers 50 and the grinding disk 60.

In the embodiments not illustrated, the axial position adjustment device may also be provided above a top cover of the shell 10 and the drive device 30, and the reset device may be provided below the base 80, and this solution has the same effect as the ninth embodiment.

Each of the above roller mills has a simple structure, and may be controlled automatically or manually, thus each of the roller mills can conveniently or automatically adjust the gap between the grinding rollers and the grinding disk.

According to the above descriptions, the above embodiments of the present application may realize the following technical effects.

1. The structure is simpler, and the production cost is reduced.

2. The axial position adjustment device is adopted to replace various structures in the conventional technology, thus the fault rate is lowered.

3. The technical solution according to the present application may achieve automatic adjustment, and save significant amount of labor and onerous work of workers.

4. The simplified structure overcomes the shortcoming that the original device cannot be manufactured to have a large size.

The above descriptions are only preferred embodiments of the present application, and are not deemed to limit the present application. For those skilled in the art, the present application may have various modifications and variations. Any modifications, equivalent replacements and improvements made within the spirit and principle of the present application should fall into the scope of the present application.

What is claimed is:

1. A roller mill, comprising:

a shell provided with a feed port and a discharge port;

a main shaft inserted in the shell and rotatable in the shell;

a drive device drivingly connected to the main shaft;

a holder mounted on the main shaft;

two or more than two grinding rollers, each of the grinding rollers mounted on the holder and rotatable around its own axis; and a grinding disk fixedly mounted in the shell at a position opposite to the two or more than two grinding rollers, wherein, the roller mill further comprises:

an axial position adjustment device connected to the main shaft and configured to drive the main shaft to move axially to adjust a position of the main shaft wherein the shell comprises a cover, a first shell, and a second shell, and wherein the cover, the first shell, and the second shell are connected and arranged from top to bottom in the listed sequence, the feed port is provided in the cover and the discharge port is provided in the second shell; and the two or more than two grinding rollers have a conical shape, and the grinding disk is fixedly mounted on the second shell and is inclined relative to a horizontal plane; and wherein the axial position adjustment device is a hydraulic cylinder, the hydraulic cylinder is arranged along a vertical direction, and comprises a cylinder body, a piston rod, and a piston, the cylinder body is fixedly arranged, and the piston divides an inner cavity of the cylinder body into an upper cavity and a lower cavity, and the piston rod is movably connected to the main shaft via the drive device and is configured to drive the main shaft to move axially to adjust the position of the main shaft; and the piston rod is not rotatable and the main shaft is rotatable.

2. The roller mill according to claim 1, further comprising:

a reset device configured to apply an axial restoring force on the main shaft after the main shaft moves axially.

3. The roller mill according to claim 2, wherein the reset device comprises an accumulator, and the accumulator is in communication with the upper cavity.

4. The roller mill according to claim 1, further comprising:

a base, wherein the shell is supported on the base, and the main shaft is supported by the base, and the main shaft has a free end located in the shell; and the drive device and the hydraulic cylinder of the roller mill are both located below the base, and the piston rod extends upward, and is movably connected to the main shaft via the drive device and is configured to drive the main shaft to move axially.

5. The roller mill according to claim 1, further comprising:

a base, wherein the shell is supported on the base, and the main shaft is supported by the base and a top cover of the shell; and the drive device and the hydraulic cylinder of the roller mill are both located below the base or both located above the shell; and the piston rod is movably connected to the main shaft via the drive device, and is configured to drive the main shaft to move axially, and the hydraulic cylinder is located at a side, away from the grinding rollers, of the drive device.

6. The roller mill according to claim 1, further comprising:

a base, wherein the shell is supported on the base, and the main shaft is supported by the base and a top cover of the shell; and the drive device of the roller mill is located above the shell, the hydraulic cylinder is located below the base, and the piston rod is movably connected to the main shaft.

7. The roller mill according to claim 1, further comprising:

a base, wherein the shell is supported on the base, and the main shaft is supported by the base and a top cover of the shell; and the drive device of the roller mill is located below the base, the hydraulic cylinder is located above the shell, and the piston rod is movably connected to the main shaft.

8. The roller mill according to claim 1, wherein the main shaft is supported by a top cover of the shell, the main shaft has a free end located in the shell, the drive device and the hydraulic cylinder are both located above the shell, and the piston rod extends downward, and is movably connected to the main shaft via the drive device, and is configured to drive the main shaft to move axially.

9. The roller mill according to claim 1, wherein each of the grinding rollers is mounted to the holder by a respective rocker arm mechanism, and the rocker arm mechanism comprises:

an articulating seat arranged on the holder;

a rocker arm, comprising a first arm and a second arm connected to each other, wherein the grinding roller is mounted to the first arm, and the first arm and the second arm are connected and form a bent connecting structure, and a portion where the first arm and the second arm are connected is articulated to the articulating seat;

a position-limiting device connected to the second arm to adjust a distance between the second arm and the holder, wherein the position-limiting device comprises a first bolt passing through the rocker arm and a first nut connected to the first bolt, a bolt head of the first bolt is located between the rocker arm and the holder, and the first nut is located above the rocker arm, and one or more spacers are selectively provided between the bolt head of the first bolt and the rocker arm; and an elastic device, comprising an elastic member configured to apply a pressure towards the holder on the second arm, wherein the elastic device comprises a second bolt passing through the holder and the rocker arm, and a second nut connected to the second bolt, a bolt head of the second bolt is located below the holder, the second nut is located above the rocker arm, and the elastic member is provided between the second nut and the rocker arm.

10. The roller mill according to claim 1, further comprising:

a base, wherein the shell is supported on the base, and the main shaft is supported by the base and a top cover of the shell; and the roller mill comprises two axial position adjustment devices, and the two axial position adjustment devices are respectively cooperated with or connected to two ends of the main shaft, and are configured to drive the main shaft to move axially, to adjust the position of the main shaft.

11. The roller mill according to claim 1, further comprising:

a base, wherein the shell is supported on the base, and the main shaft is supported by the base and a top cover of the shell; and the axial position adjustment device of the roller mill cooperates with or connects to a lower end of the main shaft, and is configured to drive the main shaft to move axially, to adjust the position of the main shaft, and the reset device is located on an upper end of the main shaft.

12. The roller mill according to claim 2, further comprising:

a base, wherein the shell is supported on the base, and the main shaft is supported by the base, and the main shaft has a free end located in the shell; and the drive device and the hydraulic cylinder of the roller mill are both located below the base, and the piston rod extends upward, and is movably connected to the main shaft via the drive device and is configured to drive the main shaft to move axially.

13. The roller mill according to claim 2, further comprising:

a base, wherein the shell is supported on the base, and the main shaft is supported by the base and a top cover of the shell; and the drive device and the hydraulic cylinder of the roller mill are both located below the base or both located above the shell; and the piston rod is movably connected to the main shaft via the drive device, and is configured to drive the main shaft to move axially, and the hydraulic cylinder is located at a side, away from the grinding rollers, of the drive device.

14. The roller mill according to claim 2, further comprising:

a base, wherein the shell is supported on the base, and the main shaft is supported by the base and a top cover of the shell; and the drive device of the roller mill is located above the shell, the hydraulic cylinder is located below the base, and the piston rod is movably connected to the main shaft.

15. The roller mill according to claim 2, further comprising:

a base, wherein the shell is supported on the base, and the main shaft is supported by the base and a top cover of the shell; and the drive device of the roller mill is located below the base, the hydraulic cylinder is located above the shell, and the piston rod is movably connected to the main shaft.

16. The roller mill according to claim 2, wherein the main shaft is supported by a top cover of the shell, the main shaft has a free end located in the shell, the drive device and the hydraulic cylinder are both located above the shell, and the piston rod extends downward, and is movably connected to the main shaft via the drive device, and is configured to drive the main shaft to move axially.

17. The roller mill according to claim 2, further comprising:

a base, wherein the shell is supported on the base, and the main shaft is supported by the base and a top cover of the shell; and the roller mill comprises two axial position adjustment devices, and the two axial position adjustment devices are respectively cooperated with or connected to two ends of the main shaft, and are configured to drive the main shaft to move axially, to adjust the position of the main shaft.

18. The roller mill according to claim 2, further comprising:

a base, wherein the shell is supported on the base, and the main shaft is supported by the base and a top cover of the shell; and the axial position adjustment device of the roller mill cooperates with or connects to a lower end of the main shaft, and is configured to drive the main shaft to move axially, to adjust the position of the main shaft, and the reset device is located on an upper end of the main shaft.

* * * * *